United States Patent [19]

Davis

[11] Patent Number: 4,927,145

[45] Date of Patent: May 22, 1990

[54] BOARD GAME APPARATUS

[76] Inventor: George M. Davis, 1826 Escambia Ave., Pensacola, Fla. 32503

[21] Appl. No.: 255,488

[22] Filed: Oct. 11, 1988

[51] Int. Cl.[5] ..... A63F 7/06; A63B 63/00

[52] U.S. Cl. ..... 273/94; 273/331; 273/354; 273/371; 273/126 A; 273/127 R

[58] Field of Search ..... 273/94, 1 E, 331–333, 273/108, 118 R, 126 R, 126 A, 128 R, 127 R, DIG. 31, 289, 371, 237, 238, 353–354

[56] References Cited

U.S. PATENT DOCUMENTS

| | | | |
|---|---|---|---|
| 516,789 | 3/1894 | Hillis | 273/94 R |
| 968,366 | 8/1910 | Krug | 273/88 |
| 1,444,734 | 2/1923 | Doerr | 273/93 R |
| 1,663,404 | 3/1928 | Hands | 273/94 R |
| 4,733,867 | 3/1988 | Kemp et al. | 273/94 R |

*Primary Examiner*—Edward M. Coven
*Assistant Examiner*—Sebastiano Passaniti

[57] ABSTRACT

A board game apparatus for playing a class of board games such as board football involving the use of a thumper disc and other removable game apparatus associated with the playing board and the rules of play. The apparatus may utilize electronic position sensing means.

10 Claims, 5 Drawing Sheets

BOARD GAME APPARATUS

BACKGROUND OF THE INVENTION

The board game apparatus according to the present invention has been developed to produce a visually attractive, competitive and exciting board game involving three significant elements for the player: skill, strategy, and chance. The game process has taken what is essentially the game function of board football, specifically the variation of football sometimes referred to as paper or matchbook football, which is believed to have originated in American school rooms sometime during the 1940's and has improved that function of play through innovative and novel adaptions. These adaptions include game components, alpha numeric and line graphics, and a new array of competitive board game possibilities that extend beyond the original board football game.

The present invention involves a complex and elaborate process which in its final form has been made to appear reasonably simple. This results directly from the degree of synthesis and coordination of the elements, including the board structure and arrangement, the game components, line graphics, optically relevant alphanumerics, and instructional facets.

This invention provides for new methods of application of a players ability while offering the player the option of selecting alternative game strategy during the progress of a game. It is a new approach to games in that it utilizes a duplication of the real game scenarios and presents the player with decisions required to execute the normal sequence of the game's progress.

In addition, this invention demands that the player develop the basic skills required to perform the normal play by play action of the game. This includes the selection of type of play or game strategy, the ability to "thump" the game disc for best results, and the ability to perform the special manual actions required to attain the best results in both the regular and in the electronic embodiments of the board game apparatus.

The purpose of this new invention is, therefore, to provide a new improved type of board game which offers a challenge to the player's mental ability and his ability to perform the required manual functions. It offers a unique combination of physical skill, strategy, and chance.

The board game apparatus according to the present invention is designed to retain the player's interest by having a playing board surface of similar design to the actual playing field of the sports game and requires that the players be somewhat familiar with that particular game. This includes game strategy, game rules, and other aspects of the games which develop an atmosphere of reality during the progress of the game.

These factors along with the application of the newly designed and developed playing apparatus makes this new invention both an entertaining and challenging experience. Others such as Witzel, U.S. Pat. No. 4,019,737 and White, U.S. Pat. No. 4,183,531 disclose earlier inventions in this area.

SUMMARY OF THE INVENTION

The board game apparatus according to the present invention is based upon a central feature of "thumping" a disc over a specialized surface in such a way and with enough inertia to propel the disc to the desired location on the playing board before friction and gravity combine to bring the disc to a halt.

In addition to the central thumper disc this invention provides for a game board based on the particular game being played. This board, in addition to being a visual representative of the particular game, also provides special game instructions, requirements, and purposes.

Board game apparatus according to the present invention is adapted for regular or manual and for an electronic embodiment.

In addition to the central thumper disc which is common to all of the embodiments of the game, each separate game apparatus may have its particular ball or other moveable device to be used for special purposes. For instance, the football game has a typical shaped football which is tethered to the game board and is used by the player to perform field goals and extra point plays, while a game of basketball may have a normally shaped basketball which is used by the player to perform the actual shooting of foul shots during play. The extra point and field goal apparatus in the football game could easily be converted to a goal for shooting baskets in a basketball version of a board game according to the present invention.

This invention comprises a game board with a playing surface treated so that said surface exhibits specialized tactility which facilitates smooth movement of a substantially flat bottomed disc across said surface. Said game board also exhibits one or more slots cut into its surface which in the case of the board football game provides a means for movement of an optically relevant yard marker, ball marker, down counter, or similar device which fits into the slot or slots in such a way as to be manually moved backward and forward so as to correspond with relevant raised graphic markings such as yard lines and alphanumerics.

This invention also comprises a flat bottom disc which is propelled by thumping across the game playing surface, the relative position of said flat disc after coming to rest being used to determine advantage or disadvantage of the player who thumped said disc. The raised graphics impede the formation of a vacuum between the game playing surface and the bottom of the disc as the disc is propelled across the playing surface.

This invention also comprises a football goal post apparatus with a detachable crossbar and uprights. The crossbar has receptacles in the form of holes drilled at intervals to receive the uprights in such a way that variations in distance between said crossbars can be achieved so that different degrees of difficulty may be attained when a player attempts field goal and extra point plays. The crossbar also has a receptacle on the bottom for the goal post.

This invention also comprises a specialized hollow plastic football shaped component which can be easily tethered to the game board, and is used for thumping field goals and extra points through the goal post uprights. The tether serves the purpose of restricting the range of movement of the hollow plastic ball and preventing its loss.

Board game apparatus according to the present invention also utilizes calibrated, instructional and perimetric alphanumeric and line graphics printed in relief or otherwise on the playing surface of the game board.

The board game apparatus according to the present invention embodies novel processes, including the integrated use of all of the above mentioned components in cooperation with the alphanumeric graphic and line graphics in a context of specified and concise game rules.

This invention has also been adapted to an electronics embodiment which includes a game board with electrical circuitry imprinted on or implanted in the playing surface, said circuitry being connected by circuit extensions from the playing surface to a digital processing unit and readout display. Electronic adaptions are also provided for the other game components such as the field goal kicking apparatus, and the thumper disc apparatus.

These components together with other devices and advantages will be seen in more detail in the following description of the invention.

DETAILED DESCRIPTION OF THE INVENTION

Figure 1:
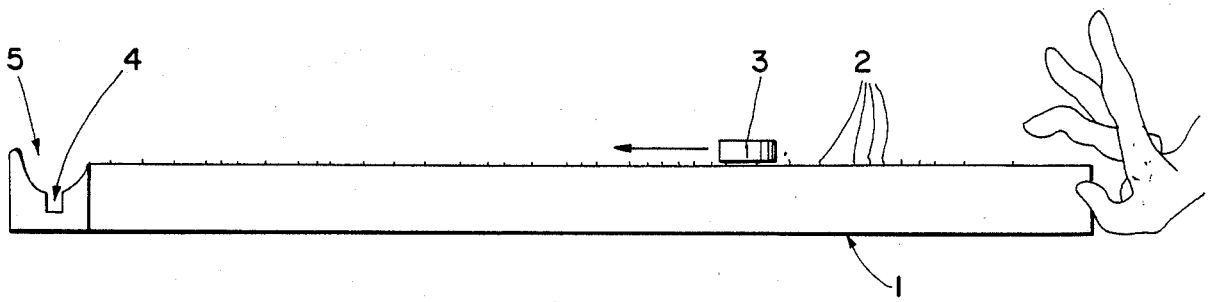
FIG. 1 is a side view of a thumper disc and a regular game board.
Figure 4:
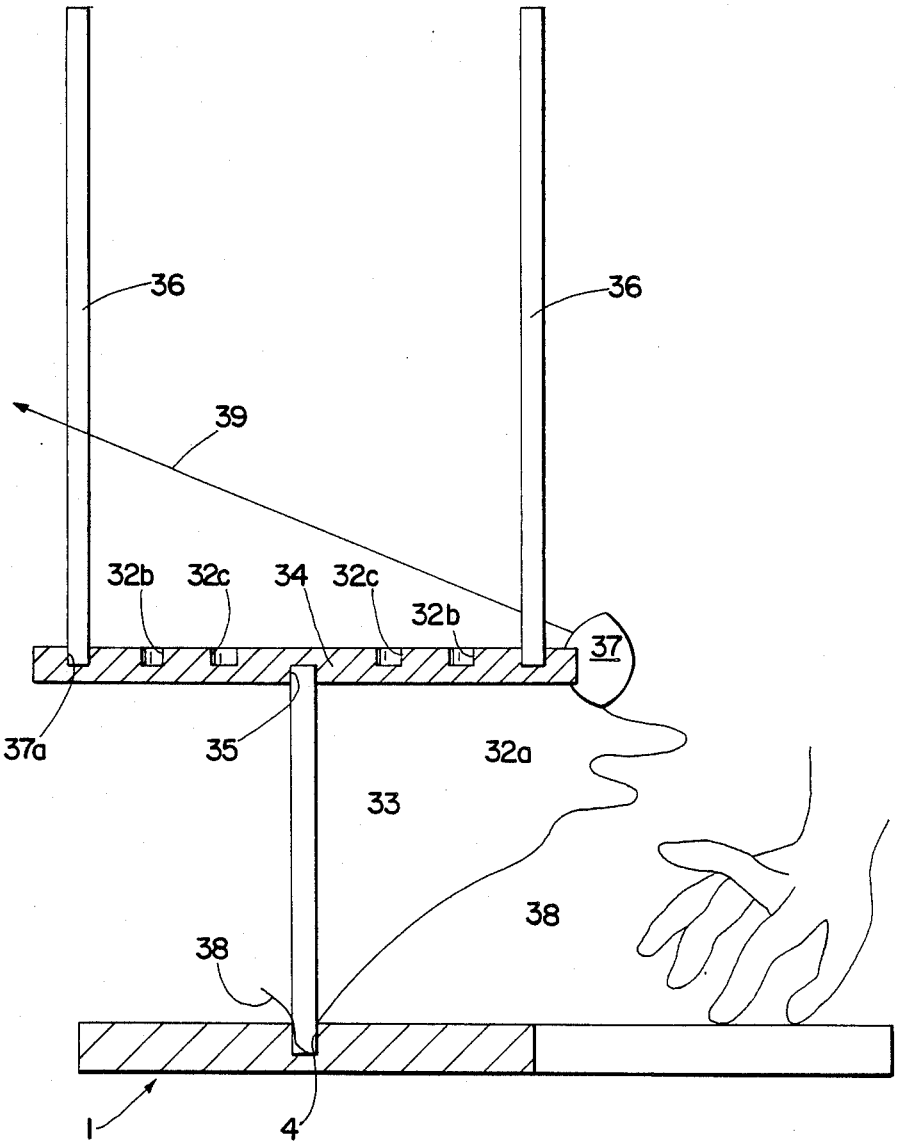
FIG. 4 is a sectional rear perspective view of the adjustable apparatus used for the manual thumping of extra points and field goals, which apparatus is shown inserted into a receptacle in the board game, and also showing other apparatus and features.

FIG. 1 shows a game board 1 which can be of various dimensions and constructed of varied materials and will usually be fabricated from one solid piece of wood or other suitable material. The game board includes relief printed indicia 2 which are slightly exaggerated in FIG. 1 and which serve as both a visual cue to the game participants and as a means of providing a slightly rough surface which facilitates the movement of the thumper disc 3 over that surface. Also shown in FIG. 1 is a goal post receptacle 4 drilled into the end of the game board and the trough or disc receptacle 5 at the end of the game board playing surface. This trough or disc receptacle is usually found on larger game boards and is used to collect or capture a disc off of the playing surface. The goal post receptacle 4 is drilled into the actual playing surface of the board itself as seen in FIG. 2 and FIG. 4.

Figure 2:
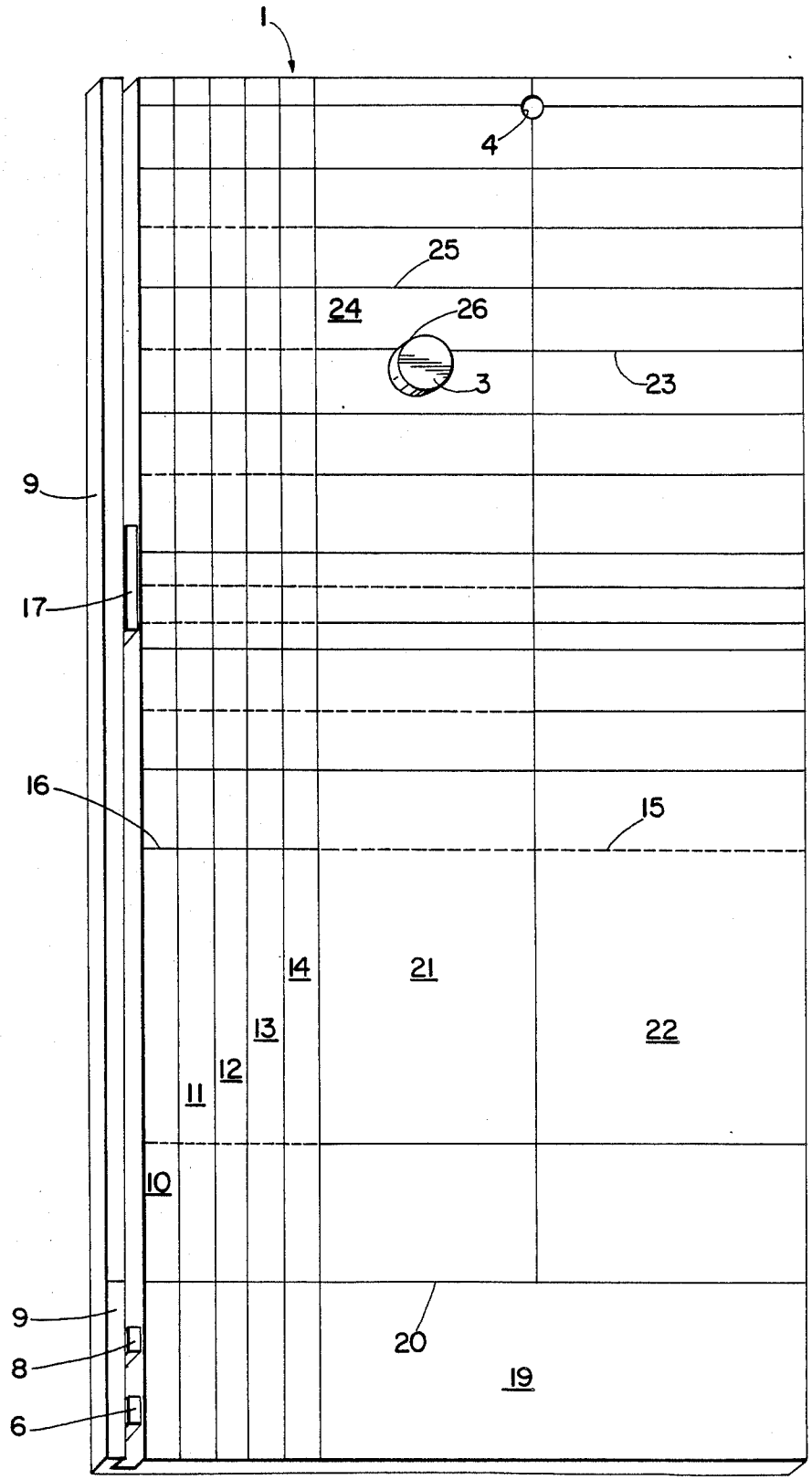
FIG. 2 is a plan view of the playing board and perimetric line graphics, also showing slots used for yard and down markers which can be moved along the slots, and showing a thumper disc resting on top of the playing surface.

In FIG. 2 a down marker means 6 is used to keep track of which down is being played in a football version of the game. The thickness of the down marker 6 is such as to allow it to be moved along the groove 7 which is located along the side of the playing board. In addition to the down marker, the possession marker means 8 and the yard marker means 17 are also fitted into this groove which is cut the length of the game board playing surface and is of a shape and size which will accommodate the placement and movement of said marker means. The possession marker 8 is identical to the down marker 6 except that its function is to keep a record of the number of offensive opportunities for one of the the teams. The outside ridge or lip 9 of the playing board is used to display printed indicia which provides visual information on the progress of play or outcome of a particular play when used in conjunction with marker means such as yard marker 17, down marker 6 and possession marker 8 as illustrated in FIGS. 2 and 3.

Figure 3:
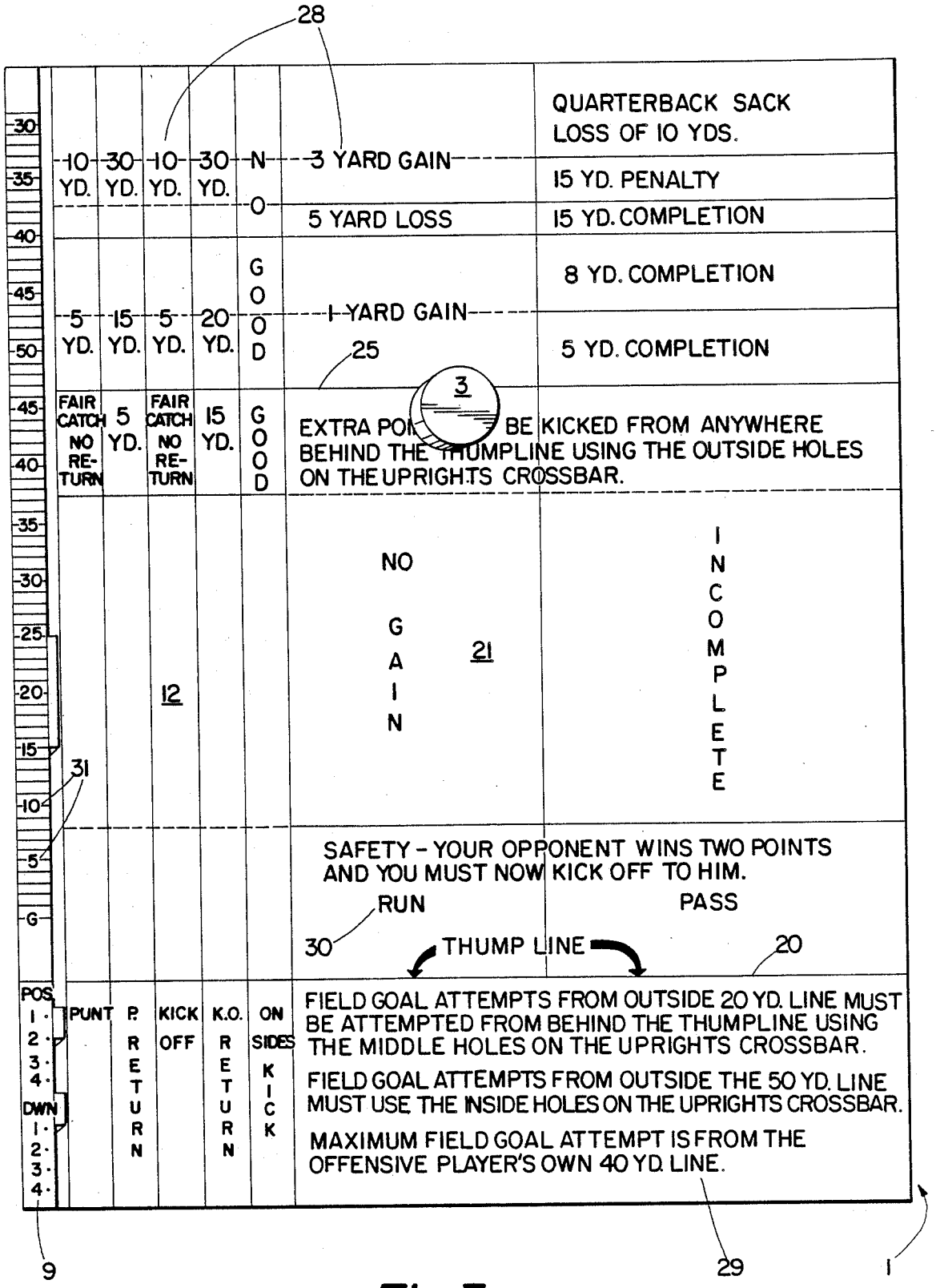
FIG. 3 illustrates a detailed plan view of the thumper football game board playing surface showing perimetric line, instructional, and other alphanumeric graphics used for areas and aspects of said playing surface, and also showing the thumper disc with the forward or leading edge extending beyond the bottom line of the "1 yard gain" designation in the run lane.

In FIG. 3 an example of graphic indicia printed on the ridge of a lip 9 is illustrated by numeral 31 referring to yard line marker numbers at the ten yard line and the five yard line in the football version of the game.

FIG. 2 also illustrates the entire layout of the line graphics on the playing surface of the game board used for a football type game. In this game the large playing surface on the right side of the groove 7 is divided into seven playing lanes, each of which is used for indicia which relates to progress on certain types of plays. For example, looking at FIG. 2 one sees to the immediate right side of the groove 7 the "punt" lane 10, to the immediate right of which is the "punt return" lane 11, next is the "kick off" lane 12, then the "kick off return" lane 13, then the "on side kick" lane 14, followed by the two widest lanes which are the "run" lane 21 and "pass" lane 22.

The broken indicator lines 15 are used to show the continuation of a solid indicator line 16 that is used as the upper and lower boundaries of the playing surface to indicate to the players what was accomplished on a particular play of the game. Some indicator lines extend across the entire width such as solid line 25. The portion 19 of the playing board behind the thumping line 20 may contain printed indicia about the rules of the game, purpose of playing lanes, etc. The "thump line" 20 extends across the width of the playing board and marks the point beyond which the thumper disc should not extend prior to thumping for a typical game such as football.

FIG. 2 also shows the thumper disc 3 having come to rest with the forward or leading edge 26 slightly past indicator line 23. This means that the indicia printed on the playing surface between indicator line 23 and indicator line 25 is used to determine the results of that particular play. In this case the printed board section 24 represents that section of the running play lane 21 which is utilized to determine the play results.

Board graphic indicia 28 as shown in FIG. 3 for both the regular and for the electronics embodiment of a board game according to the present invention will often be printed by a process such as screen printing which results in a print which is slightly raised above the playing surface of the board itself. The indicator lines 25 which run across the width of the playing surface of the board, and which are used to determine the results of particular plays of the game, will usually be screened or otherwise printed in relief or slightly raised above the surface.

Other areas of the playing board may be used for displaying rules or instructions 29 about the use of that particular game, or instructions about the use of that particular section of the playing board for that particular game. For instance, the kick off lane 12 and the running play lane 21 for the football adaption of a game according to the present invention has playing instructions 30 and results 28 printed on the playing surfaces, while the outer edge of the board 9 has yard marks, downs, possessions, or other indicia.

FIG. 4 illustrates the goal posts and other accessory apparatus for the regular football game according to the present invention. The bottom support post 33 fits into the receptacle 4 on the game board 1 and the goal post crossbar 34 has a hole 35 into which the support post 33 fits. On top of the crossbar 34 there are three holes 32*a*, 32*b* and 32*c* on each side of center. Using a different set of these holes 32 to place the uprights 36 to provide different distances between them for different plays will create various levels of difficulty for the kicking plays. The uprights 36 are cylindrical or otherwise shaped sticks, tubes, or rods through the football 37, on a tether 38, is kicked for extra points or for field goals. The football 37 is constructed of light material and is shaped somewhat like a football, and is "thumped" with a finger in such a way as to encourage it to follow a trajectory 39 through the uprights 37.

Figure 5:
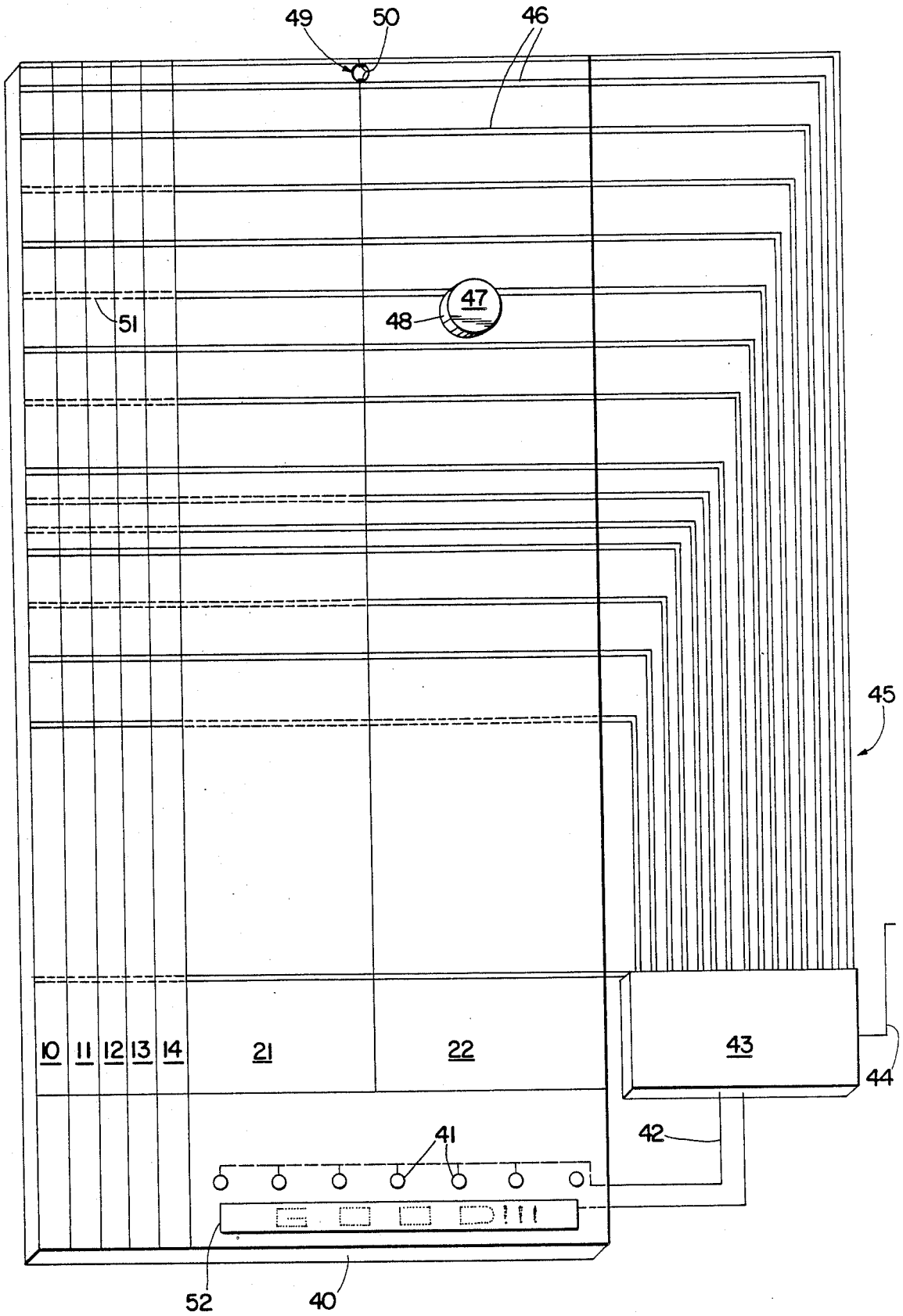
FIG. 5 is a plan view, partially schematic of an electronic embodiment of the thumper game board playing surface comprising perimetric line graphics which consist of screened conductors extending from the playing surface to a data processing unit.

FIG. 5 shows an electronic embodiment of a football board game according to the present invention that has the same basic printed line graphics layout on the playing surface as the regular thumper board game upon which it is based. In one embodiment the imprinted line graphics 46 running across the surface of the board 40 perpendicular to the intended direction of the electronic thumper disc 47 may be comprised of conductive or metallic material capable of being connected or closed at any point along the width of the playing surface. Each of these lines serves as one visual indicator line in the game itself, but comprises two parallel, electrically conductive printed means such that where metallic contact is established at any set of points along their length by the metallic or electroplated bottom surface of the bottom of the thumper disc 48, an electric signal is generated by the circuit closure. In an alternative electronic embodiment (not shown), electrically conductive lines may be embedded in the board surface to cooperatively interact with the thumper disc using capacitive or electromagnetic effects to permit electronic sensing of the position of the thumper disc.

The control buttons 41 are used to turn power on and to select the type of play. The play selections are programmed into the digital processing unit 43 and are selected by means of electronic cable 42. The results of a particular play are transmitted by playing board output circuits 45 and processed in the digital processing unit 43 and fed to the digital display readout 52 over the cable 42. The electronics playing board receives power input 44 from a power reducing transformer and typical wall plug or from a suitable battery pack (not shown).

The metallic bottom 48 of the electronic thumper disc 47 (FIGS. 5 and 6) is used as an electrical conductor as it passes over or stops on the electronic circuitry double lines 46 that feed signals to the data processing unit 43 via the connecting data links 45. Some electronic circuit double lines have segments that appear broken visually but are, actually, continuous circuits 51. The receptacle for the thumper electronics game board football goal posts 49 has metal contact points 50 that make contact with points 63 on the football goal post as shown in FIG. 8.

Figure 6:
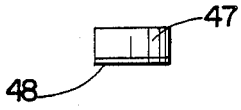
FIG. 6 is a side view of a thumper disc for use in one of the electronic embodiments.

In FIG. 6 the electronic thumper disc 47 is seen in detail from the side. The bottom of the disc 48 is metallic and is capable of conducting electric current. In an electronic embodiment using conductive lines embedded in the board (not shown), the thumper disc must be fabricated from a material having suitable dielectric or electromagnetic properties, to permit suitable electronic sensing of disc position using capacitive or electromagnetic effects.

Figure 7:
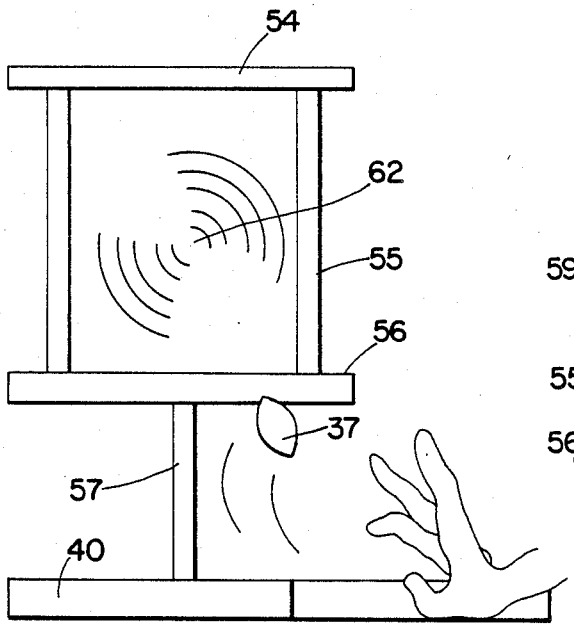
FIG. 7 is a perspective view, partially schematic of the electronic embodiment of the field goal kicking apparatus.

FIG. 7 illustrates the process of manually thumping the light weight non-metallic football shaped object or projectile 37 toward the electromagnetically charged field in the aperture 62, creating an electrically measurable disturbance in the field when the projectile passes through the field.

Figure 8:
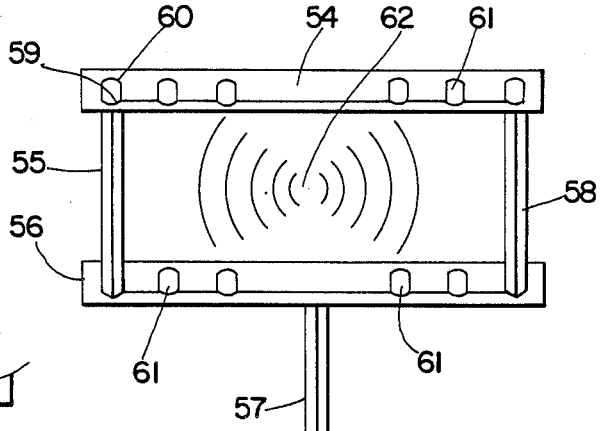
FIG. 8 is a perspective view, partially schematic of the electronic embodiment including field goal apparatus, game board with circuits, digital processing unit, and an electronic digital readout.
Figure 8:
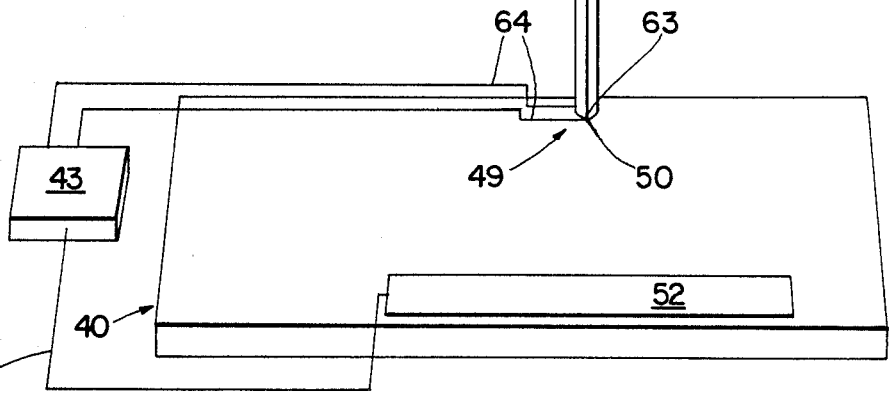

FIG. 8 illustrates the appropriate electronic field goal and extra point mechanism set up for play with the other electronic football apparatus, including the goal post 57 which fits into the receptacle 49, thereby making electrical contact when points in the receptacle 50 come into contact with points 63 on the goal post 57. The goal post uprights 55 fit into one set of the three available sets of slots 61 on the bottom crossbar 56 and top crossbar 54, and make contact between the electrical contact points 59 and 60. These contact points are connected together via circuitry 58 and create an electromagnetic field 62. A signal input is provided to the data processing unit 43 via electronic lines 64, whenever the electromagnetic field 62 is distorted by the penetration of the object 37. The digital display unit 52 then receives a signal from the line 53 included in cable 42 and reveals the results.

Figure 9:
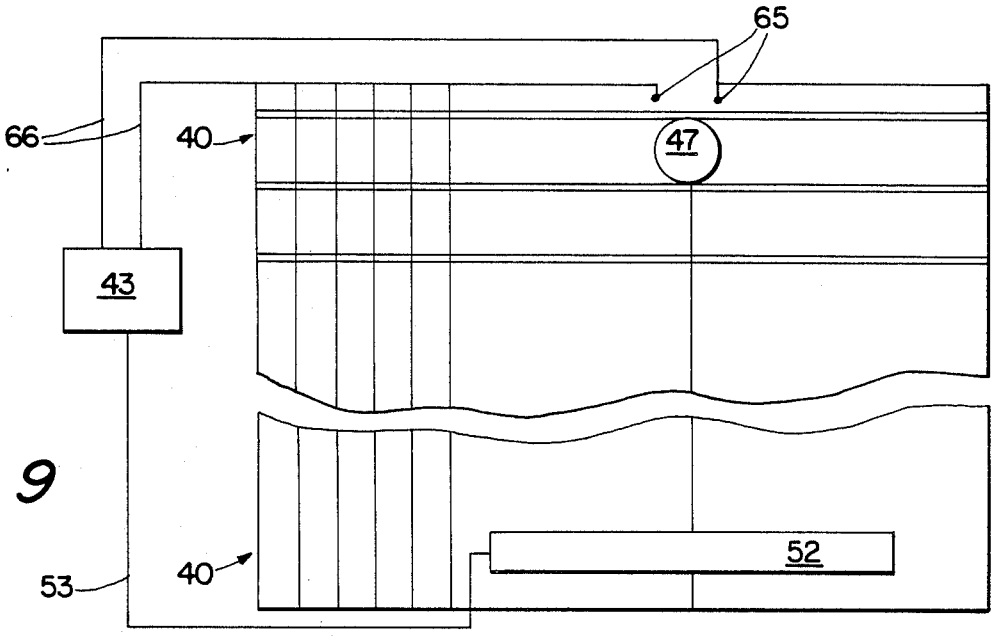
FIG. 9 is a sectional plan view, partially schematic of an alternative electronic playing surface showing the electronic thumper disc just below contact points on the surface of the board used with said disc to register field goal attempts and extra points.

FIG. 9 shows an alternative embodiment for the goal post crossbars and uprights as shown in FIGS. 7 and 8 in which the two points 65 are used to determine if the electronic thumper disc 47 has passed over each one simultaneously, closing the circuits 66 and registering a field goal or extra point. Here the different distances from the point of "thump" are used to create different levels of difficulty.

While the basic invention has been disclosed it is understood that my intention is that my invention is not to be limited to such disclosures since it may be expanded through the application of my basic invention principles. Also, it should be understood that changes and modifications in the form, construction, arrangements, types of games played, and combination of devices and methods of playing the games may be made, substituted for those shown and described herein without departing from the nature and principles of my invention.

What is claimed is:

1. A board game apparatus comprising:

a planar playing board having line graphics and alphanumeric graphics printed thereon;

a flat disc shaped object adapted to be propelled by the manual thumping method across said playing board;

said line and alphanumeric graphics comprising indicia means for determining the outcome of a play by a player propelling said disc by the manual thumping method in accordance with predetermined game rules;

the surface of said playing board having suitable surface unevenness to impede the formation of a vacuum between said disc and surface while said disc is being propelled across said surface; and auxiliary game apparatus adapted to be used in combination with said playing board and disc during play, including a removably mountable goal apparatus adapted to be mounted in a receptacle formed in said playing board, said goal apparatus comprising a central post member, a crossbar member connected to said central post member, and two upright members removably mountable on said crossbar member.

2. A board game apparatus according to claim 1 further comprising:

a slot formed along an edge of said playing board;

markers adapted to be movably positioned in and along said slot; and indicia means positioned along said slot for indicating the status of play of a game based upon the position of said markers along said slot.

3. A board game apparatus according to claims 1 or 2 further comprising trough means disposed along an edge of said playing board for collecting said disc when it is propelled off of the surface of the playing board.

4. A board game apparatus comprising:

a planar playing board having line graphics and alphanumeric graphics printed thereon;

a flat disc shaped object adapted to be propelled by the manual thumping method across said playing board;

said line and alphanumeric graphics comprising indicia means for determining the outcome of a play by a player propelling said disc by the manual thumping method in accordance with predetermined game rules;

the surface of said playing board having suitable surface unevenness to impede the formation of a vacuum between said disc and surface while said disc is being propelled across said surface;

a plurality of distributed conductor means associated with said laying board for generating signals relating to the position of said disc relative to said playing board, said disc having appropriate characteristics to interact cooperatively with said conductor means to generate said signals; and auxiliary game apparatus adapted to be used in combination with said playing board and disc during play, including a removably mountable goal apparatus adapted to be mounted in a receptacle formed in said playing board, said goal apparatus comprising a central post member, a crossbar member connected to said central post member, and two upright members removably mountable on said crossbar member.

5. A board game apparatus according to claim 4 wherein certain of said line graphics on said playing board comprise said conductor means and wherein one of the flat surfaces of said disc comprises a metallic conductor.

6. A board game apparatus according to claim 4 further comprising:

a slot formed along an edge of said playing board;

markers adapted to be movably positioned in and along said slot; and indicia means positioned along said slot for indicating the status of play of a game based upon the position of said markers along said slot.

7. A board game apparatus according to claim 5 further comprising:

a slot formed along an edge of said playing board;

markers adapted to be movably positioned in and along said slot; and indicia means positioned along said slot for indicating the status of play of a game based upon the position of said markers along said slot.

8. A board game apparatus according to claims 4, 5, 6, or 7 further comprising trough means disposed along an edge of said playing board for collecting said disc when it is propelled off of the surface of the playing board.

9. A game board apparatus according to claim 1 or 2 further comprising a tethered projectile.

10. A board game apparatus comprising:

a planar playing board having line graphics and alphanumeric graphics printed thereon;

a flat disc shaped object adapted to be propelled by the manual thumping method across said playing board;

said line and alphanumeric graphics comprising indicia means for determining the outcome of a play by a player propelling said disc by the manual thumping method in accordance with predetermined game rules;

the surface of said playing board having suitable surface unevenness to impede the formation of a vacuum between said disc and surface while said disc is being propelled across said surface;

a plurality of distributed conductor means associated with said playing board for generating signals relating to the position of said disc relative to said playing board, said disc having appropriate characteristics to interact cooperatively with said conductor means to generate said signals; and auxiliary game apparatus adapted to be used in combination with said playing board and disc during play, including an auxiliary goal apparatus having a crossbar member and means for adjusting a goal opening.

* * * * *